United States Patent [19]

Visentin et al.

[11] Patent Number: 5,059,136

[45] Date of Patent: Oct. 22, 1991

[54] APPARATUS FOR MAKING CONTAINER FIBER TUBES STARTING FROM A SHEET MATERIAL

[76] Inventors: Sergio Visentin, Via IV Novembre, 12 -- 20039 Varedo (Milano); Romeo Visentin, Via Pastrengo, 39/41 -- 20039 Varedo (Milano), both of Italy

[21] Appl. No.: 339,210

[22] Filed: Apr. 14, 1989

[30] Foreign Application Priority Data

Apr. 28, 1988 [IT] Italy ..... 20327 A/88

[51] Int. Cl.[5] ..... B31C 7/02; B31C 1/00

[52] U.S. Cl. ..... 493/296; 493/276; 493/287; 493/303

[58] Field of Search ..... 493/287, 290, 296, 303, 493/373, 276

[56] References Cited

U.S. PATENT DOCUMENTS

| | | | |
|---|---|---|---|
| 1,571,852 | 2/1926 | McCall | 493/296 |
| 2,001,177 | 5/1935 | Bodor | 493/296 |
| 3,297,315 | 1/1967 | Kunz | 493/438 |
| 4,170,172 | 10/1979 | Wommelsdorf | 493/296 |
| 4,295,842 | 10/1981 | Bell | 493/373 |
| 4,305,716 | 12/1981 | Nickum | 493/373 |
| 4,398,904 | 8/1983 | Fagerberg | 493/296 |

*Primary Examiner*—William E. Terrell

*Attorney, Agent, or Firm*—Bucknam and Archer

[57] ABSTRACT

The invention relates to an apparatus for making frustum of cone shaped fibre barrels, comprising a substantially frustum of cone shaped drum (1) which is associated with driving means able of rotating the drum about its axis comprising means for removably holding a paper sheet to be processed. On this drum operate paper sheet pressing means and upstream of the drum there is provided a paper sheet supplying roller (8), the paper sheets having, on at least a face thereof, at least an adhesive material layer, an adjustable cutting assembly being further arranged between the drum and paper sheet supplying roller.

2 Claims, 9 Drawing Sheets

6
21
20
24
22
1
20

APPARATUS FOR MAKING CONTAINER FIBER TUBES STARTING FROM A SHEET MATERIAL

BACKGROUND OF THE INVENTION

The present invention relates to an automatic apparatus for making frustum of cone shaped fibre container tubes, and the thus made barrels.

As is known, several types of vessels are presently commercially available which are made by a plurality of Kraft paper sheets which are mutually superimposed and associated so as to provide a small weight and strong construction.

These vessels or drums, which are broadly used in a lot of industrial applications, have a generally cylindrical shape which causes several problems, since it does not afford the possibility of mutually stacking empty vessels in order to easily transport them.

Moreover known apparatus for making these vessels require a lot of manual labour, in order to properly arrange the paper sheets on a forming drum.

SUMMARY OF THE INVENTION

Accordingly, the task of the present invention is to overcome the above mentioned drawbacks, by providing a fully automatic apparatus for making fibre tubes, of substantially frustum of cone shape, adapted to be easily and quickly stacked onto one another.

Within the scope of the above mentioned task, a main object of the present invention is to provide such an apparatus which is very simple construction-wise and very reliable in operation.

According to one aspect of the present invention, the above task and object, as well as yet other objects, which will become more apparent hereinafter, are achieved by an automatic apparatus for making frustum of cone fibre tubes, characterized in that said apparatus comprises a substantially frustum of cone shaped drum, rotatively driven by driving means, and provided with means for removably processing a paper sheet, paper sheet pressing means operating on said drum and a paper sheet supplying roller arranged upstream of said drum and adapted to supply a paper sheet delivered from a delivery bobbin and having, on at least a face thereof, an adhesive layer, a cutting assembly being arranged between said drum and paper sheet supplying roller.

BRIEF DESCRIPTION OF THE DRAWINGS

Further characteristics and advantages of the invention will become more apparent hereinafter from the following detailed description of a preferred, though not exclusive, embodiment of an automatic apparatus for making frustum of cone shaped fibre tubes according to the invention, which is illustrated, by way of an indicative but not limitative example, in the figures of the accompanying drawings, where.

DESCRIPTION OF THE PREFERRED EMBODIMENT

Figure 1:
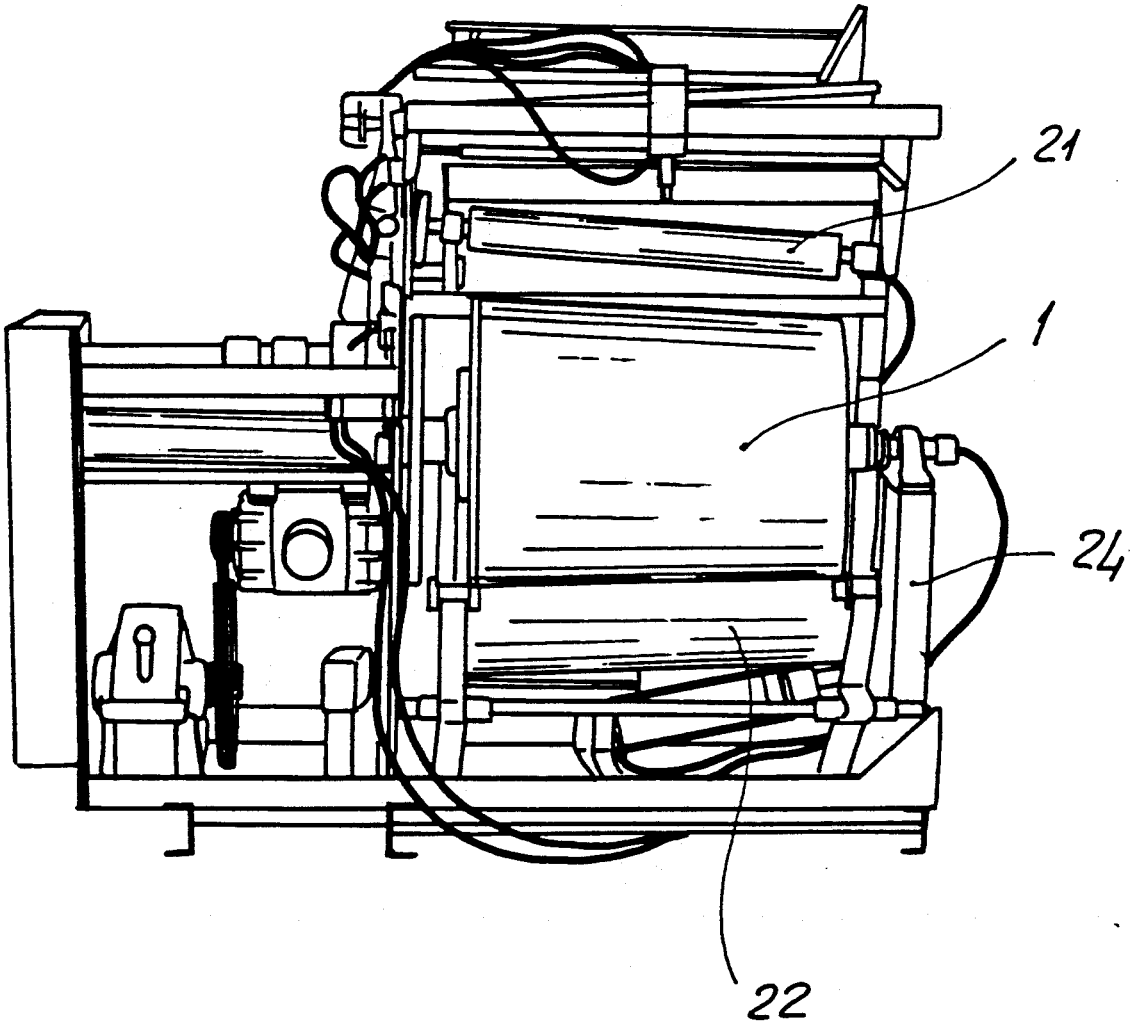
FIGS. 1 and 2 are respectively schematic front and side views illustrating the apparatus according to the present invention.
Figure 2:
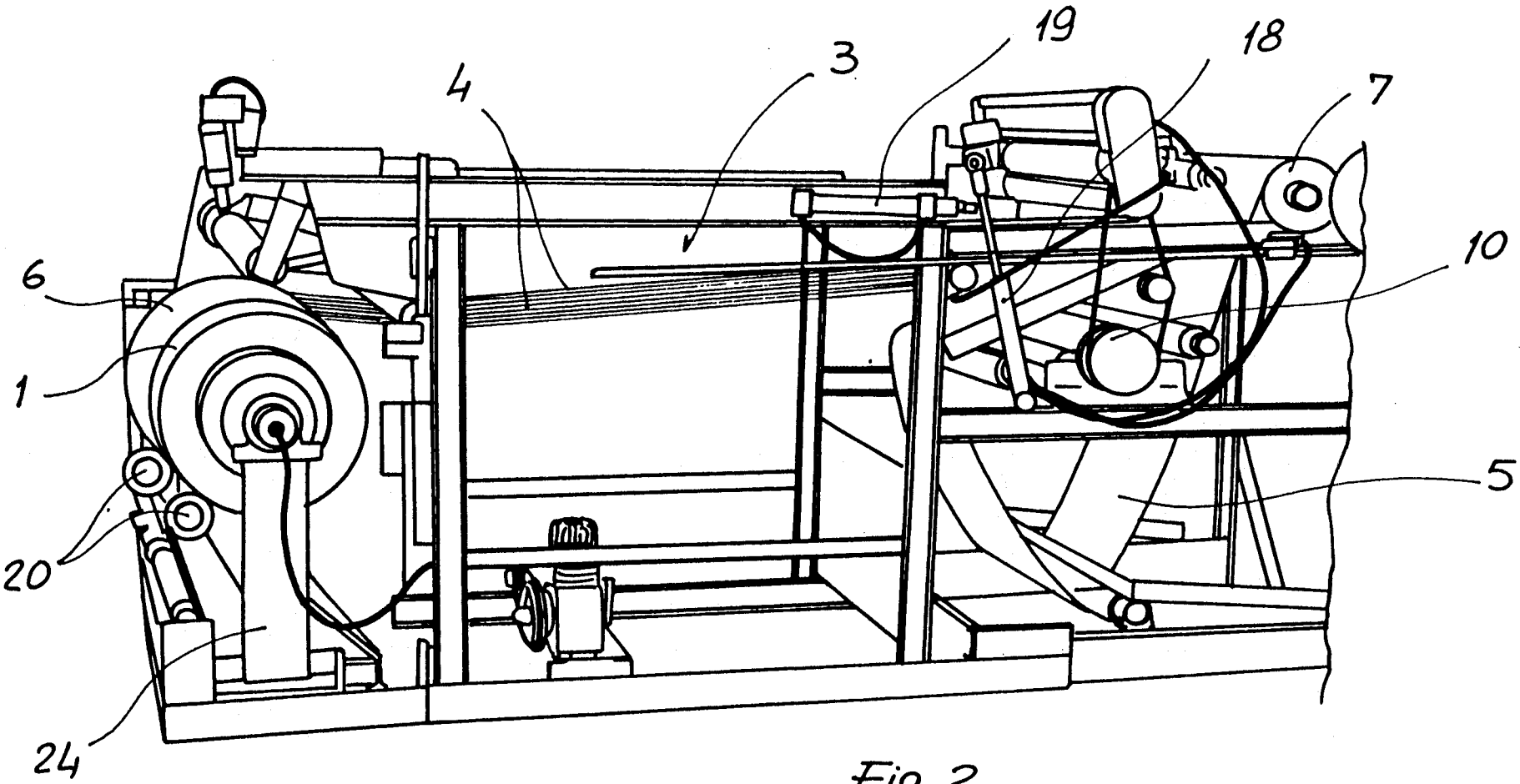

With reference to the figures of the accompanying drawings, the automatic apparatus for making frustum of cone shaped fibre tubes according to the present invention comprises a substantially frustum of cone shaped drum 1 which is rotatively driven about its horizontal axis by driving means.

As shown, the drum 1 is provided, on its surface, with a plurality of throughgoing holes 2 which are arranged along a generatrix line and coupled to a vacuum source in order to provide a negative pressure therethrough.

Upstream of the drum 1, in the paper sheet supplying direction, there is provided a slanted surface 3 formed by a plurality of adjoining round cross-section members 4 thereon the paper sheet for making the fibre barrel slides, said tube being indicated overally at the reference number 6.

More specifically, the paper sheet, preferably of the Kraft type, is delivered from a delivery bobbin 7 and is entrained by a paper sheet supplying roller 8 associated with driving means.

Figure 7:
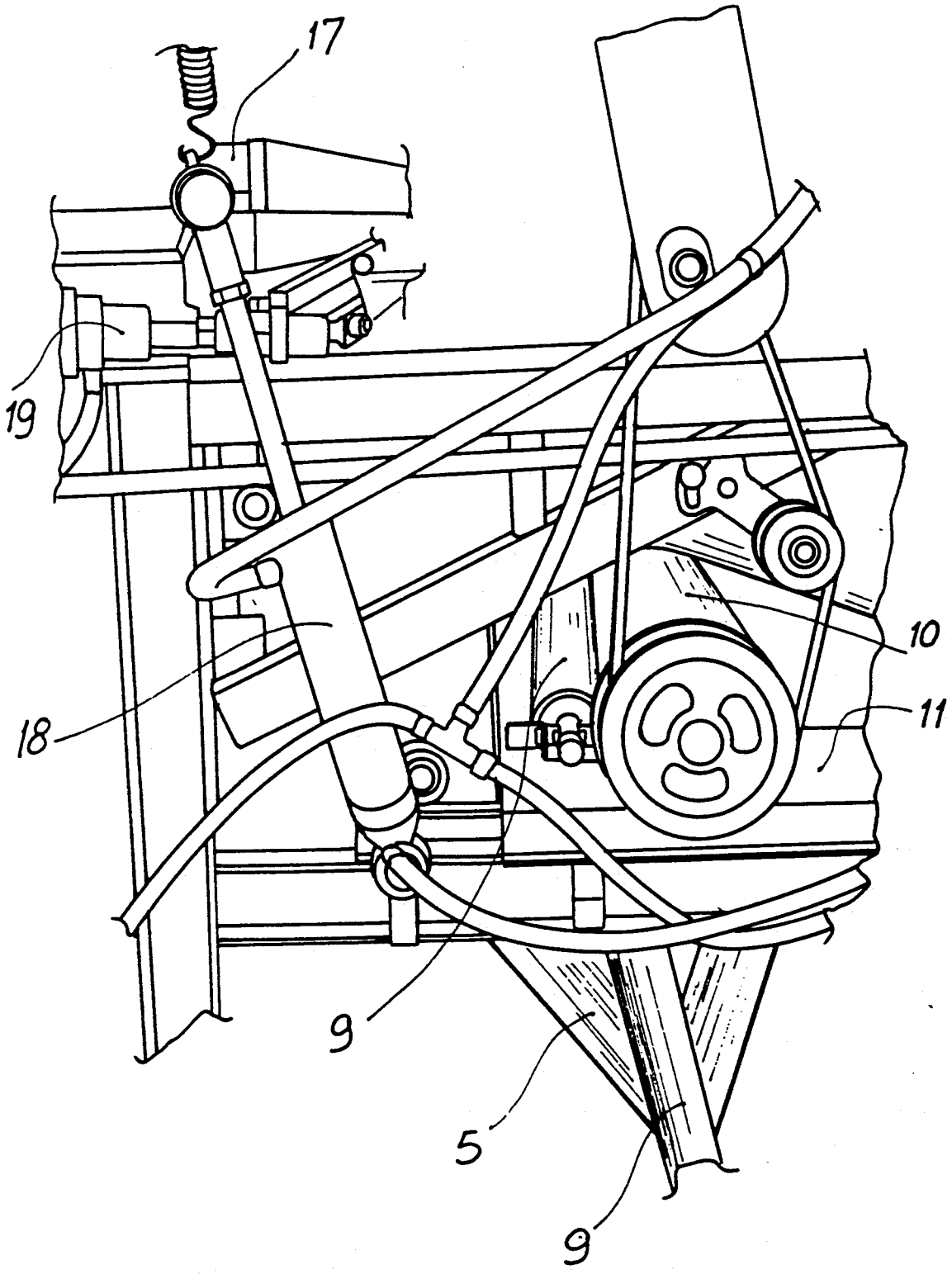
FIGS. 7 and 8 schematically illustrate two positions which can be assumed by the paper sheet cutting assembly.
Figure 8:
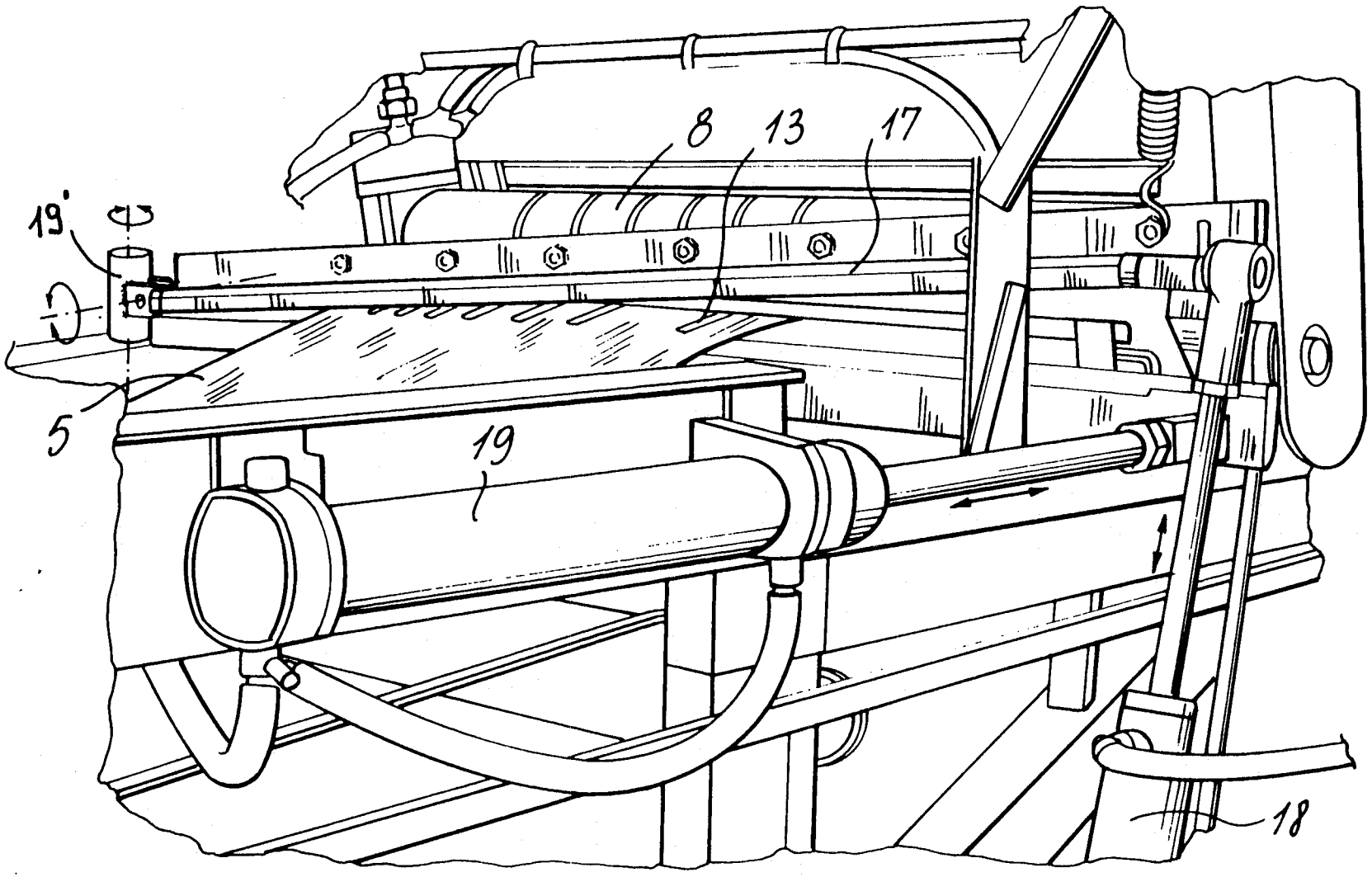
Figure 9:
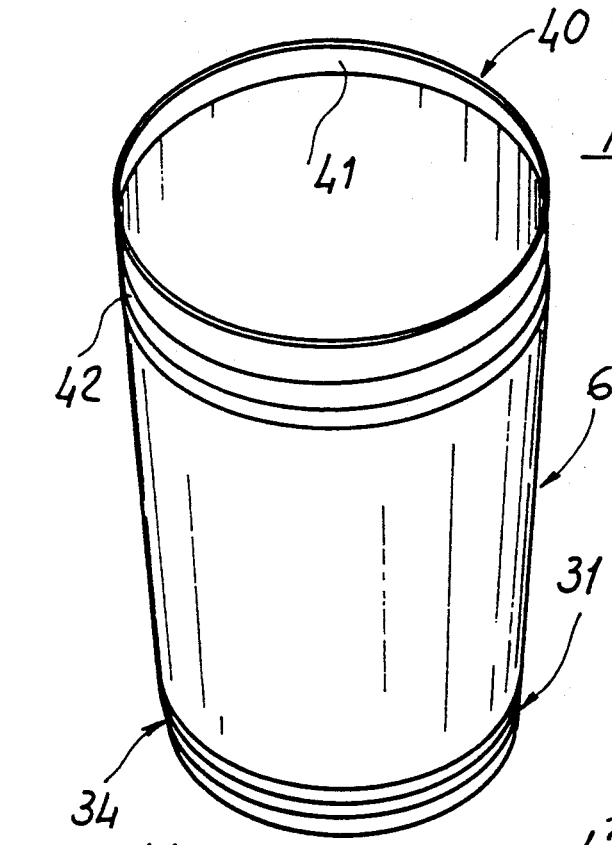
FIG. 9 is a perspective view showing a container tube made by the subject apparatus.

In particular, the paper sheet 5, (FIG. 7) entrained on entraining rollers 9, is sent to a roller 10 communicating with a basin 11 holding a preferably liquid adhesive material provided for coating a face of each paper sheet.

Figure 5:
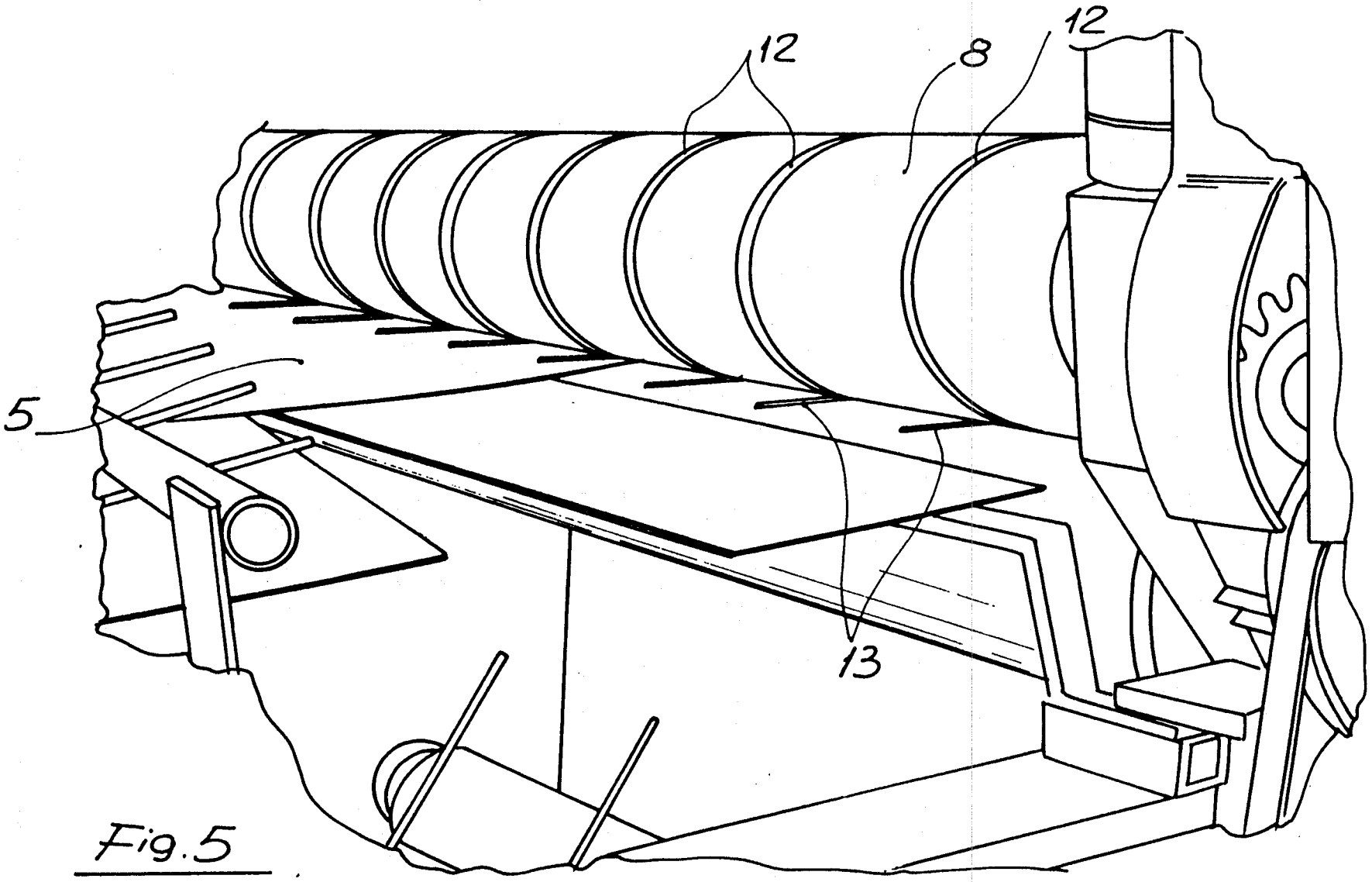
FIG. 5 shows the driven roller for supplying paper sheets.

As shown in FIG. 5, the paper sheet supplying roller 8 is provided with a plurality of circumferential slots 12, evenly spaced from one another, tangentially of which there are arranged corresponding teeth 13 arranged with a comb like arrangement.

These teeth, in particular, are specifically provided for preventing a preglued paper sheet, passing under said teeth, from adhering to the paper sheet supplying roller, while contacting the latter.

Figure 6:
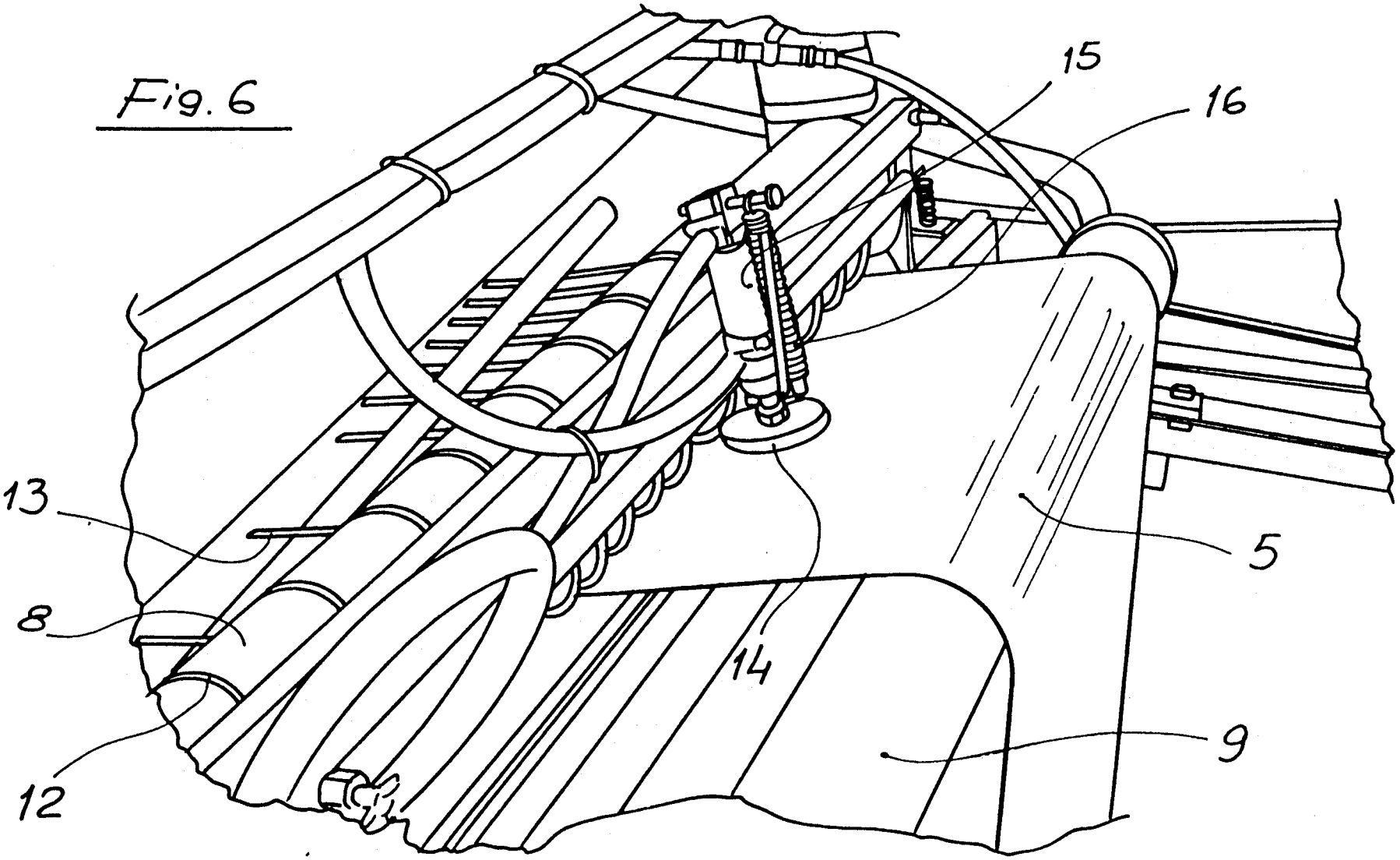
FIG. 6 shows a paper sheet holding device during the paper sheet cutting operation.

Upstream of the paper sheet supplying roller 8 (FIG. 6) there is provided a locking member, which substantially consists of a pad 14 which is driven to be raised and lowered by a double acting cylinder 15, either of the hydraulic or air type, therewith a return spring 16 cooperates.

This locking member, in actual practice, is so designed and arranged as to firmly glue the paper sheet 5, during the paper sheet cutting step, in order to provide a desired size paper sheet for making the barrel 6.

In this connection, it should be pointed out that the paper sheet cutting device consists of a cutting blade 17, (FIG. 7) articulated at one end thereof, and displaced with a reciprocating rotary movement in a plane perpendicular to the paper sheet plane, by means of a cylinder 18.

On that same cutting blade 17, which forms the paper sheet cutting assembly, operates a second double acting cylinder 19 provided for driving with a swinging movement the blade about an axis 19' which is substantially perpendicular to the sheet plane.

Thus, owing to the disclosed arrangement, the paper sheet can be cut to the desired size according to slanted lines in order to perfectly fit the flat extension of the barrel being made.

Figure 4:
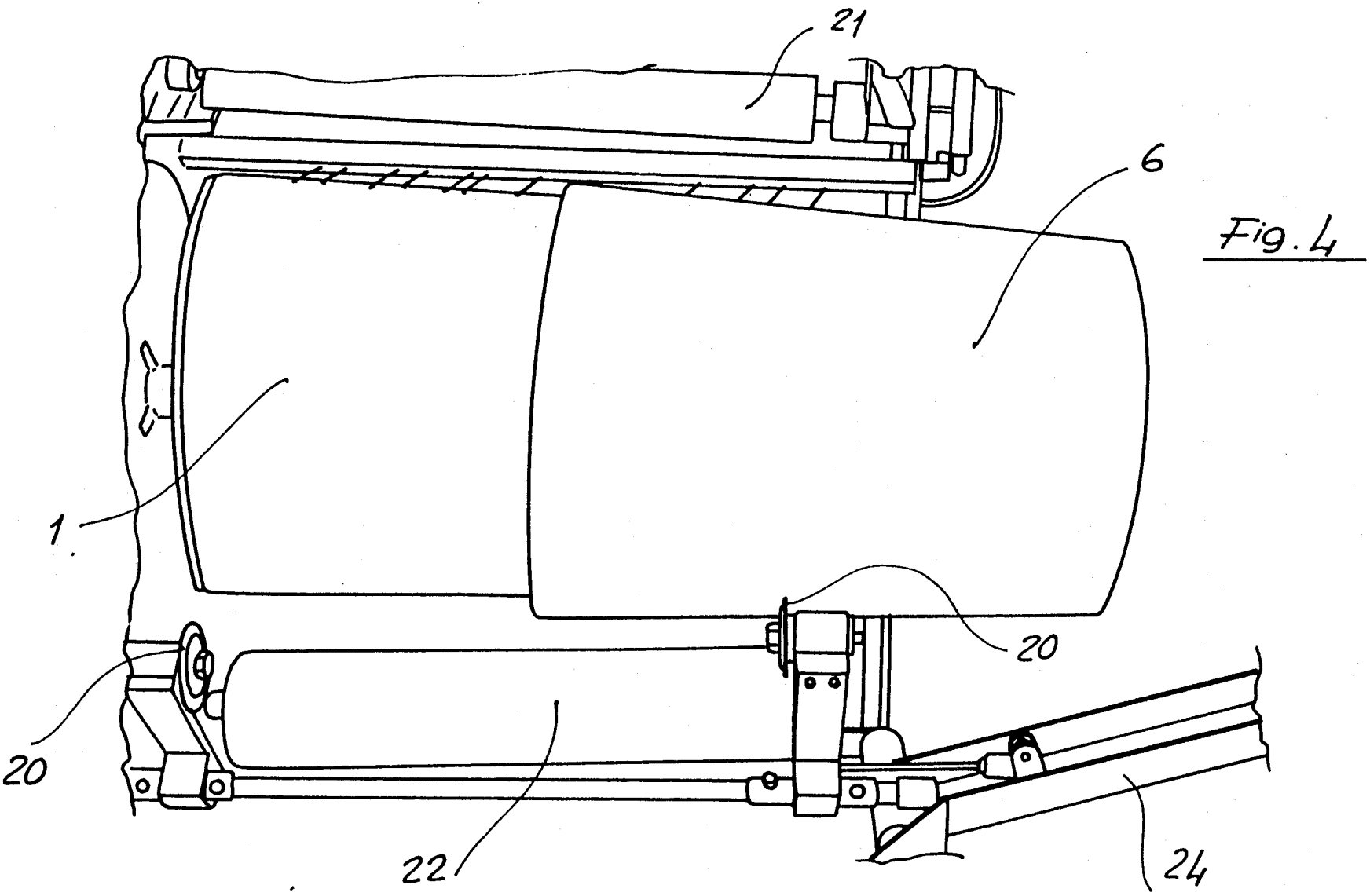

At the axial end portions of the drum 1 there are provided disc blades 20 (FIG. 4) which are mounted on jointly tiltable arms, and adapted to axially trim, along the circular perimeter, the paper sheet as it is wound on the drum.

Paper sheet pressing rollers, respectively a top pressing roller 21 and a bottom pressing roller 22 cooperate with said drum, said pressing rollers being displaced with a parallel relationship so as to contact the wall of the drum.

For forming a container tube, the preliminary cut sheet is applied to the drum 1 at the suction holes and is arranged on the surface of the drum as the latter is rotated.

Then, the above disclosed operating sequence is programmed through sensors and the like transducing elements, so as to be performed in a completely automatic way.

Figure 3:
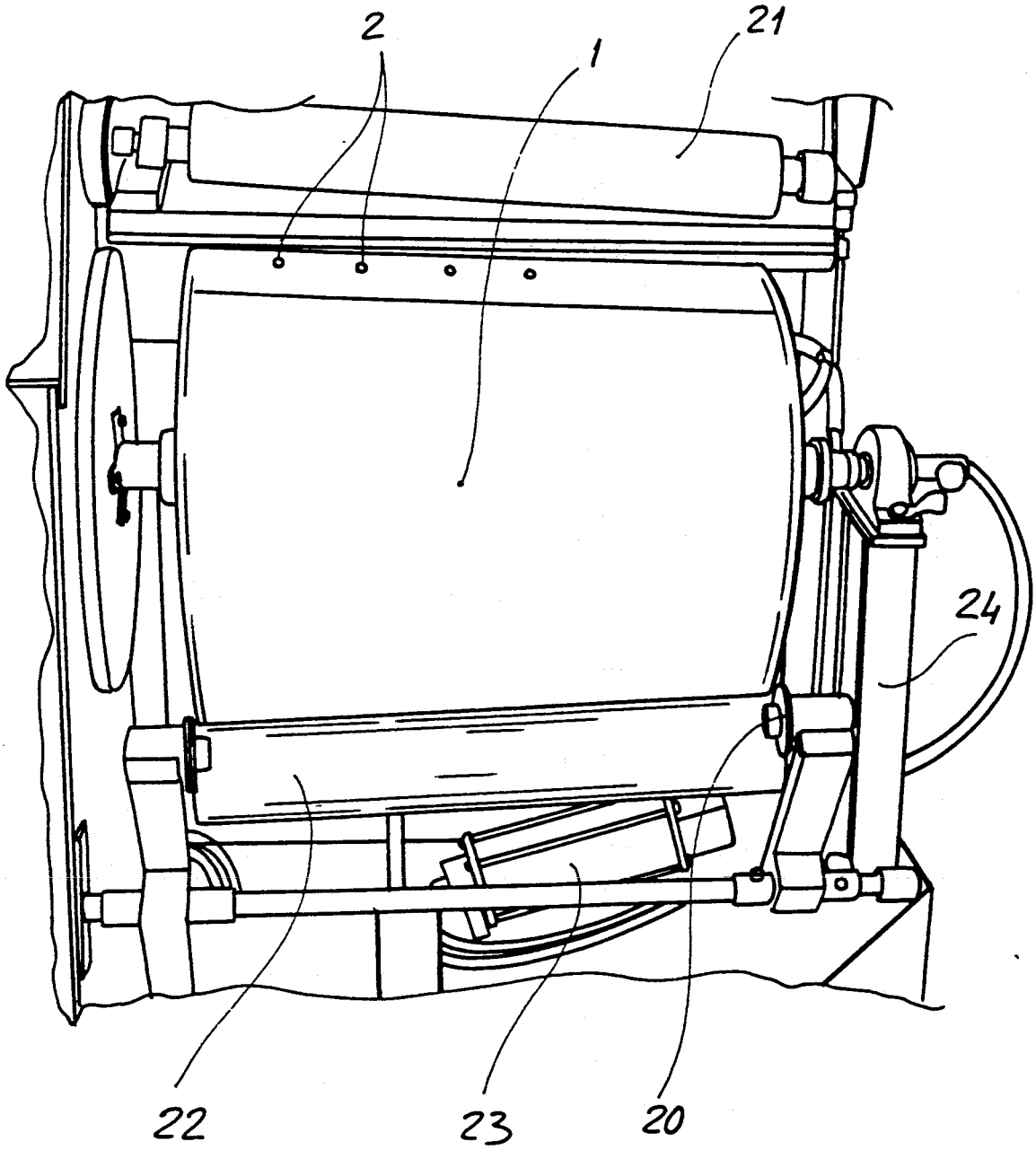
FIGS. 3 and 4 shows the winding drum included in the apparatus of the invention respectively during the barrel forming steps and formed barrel discharging step.

At the end of this operating sequence, the cylinder 23 (FIG. 3) will cause the arm 24 to be downwardly tilted so as to afford the possibility of removing from the drum the made tube body, which barrel body practically consists of the circumferential surface of the tube itself.

With reference to FIGS. 9 to 12 after having formed the tube body 6, a bottom is applied to this body, which bottom is also preferably formed by superimposing a plurality of Kraft paper sheets, by means of the bottom edge portion 31 having a circular extension and comprising a bottom leg 32 which is arranged under the bottom 30 in order to facilitate its coupling to the tube body.

On the circumferential surface of the bottom edge portion there is moreover provided a recess 34 which circumferentially extends and is provided for stiffening said edge portion, in addition to facilitating the coupling of the tube body.

At the top edge of the tube body 6, which forms the main base of said body, there is applied a band edge portion 40 which is clamped to the edge and is provided with an inwardly bent edge 41 as well as with a circumferentially extending lug 42.

This lug, in addition to stiffening the assembly, generates a larger diameter portion adapted to prevent a barrel from being fixedly restrained in a underlying barrel of the stack.

Figure 10:
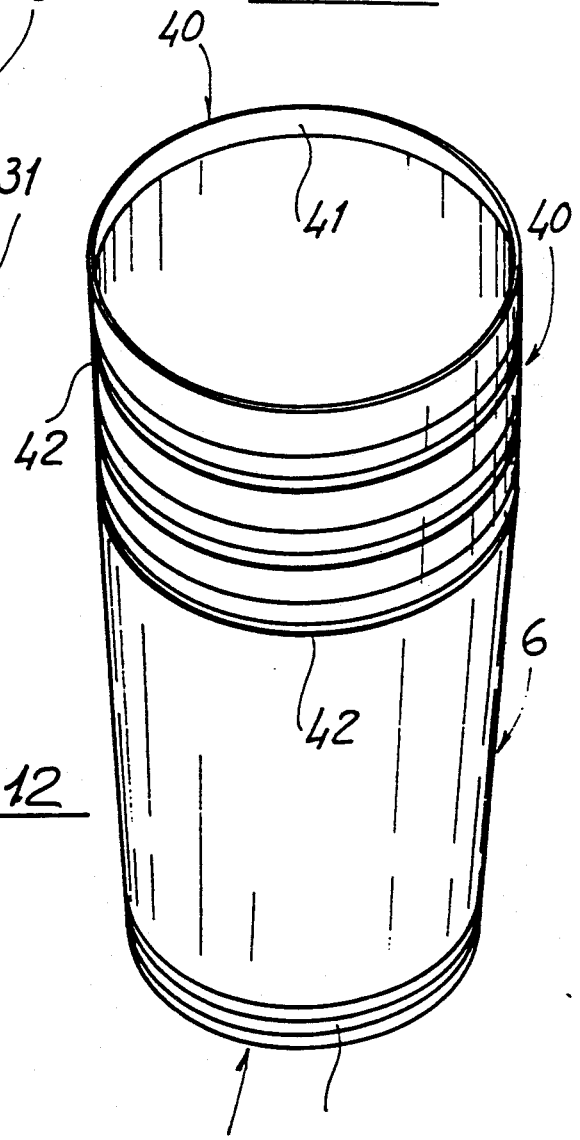
FIG. 10 shows a plurality of tubes stacked onto one another.
Figure 12:
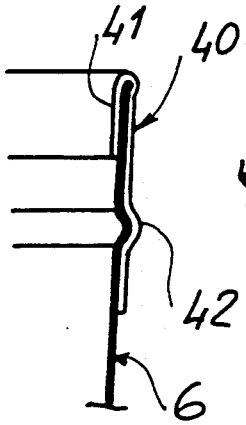
FIG. 12 is a schematic cross-sectional view illustrating the edge region of two stacked tubes.
Figure 12:
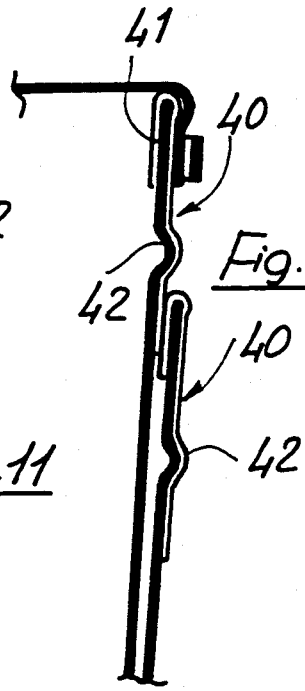
Figure 11:
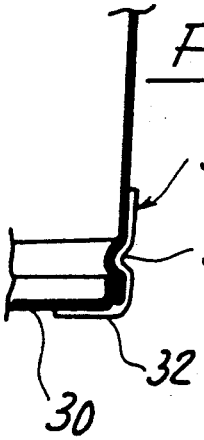
FIG. 11 shows, on an enlarged scale, the detail of the bottom and top edge portion which can be applied to the tubes.

As is clearly shown in FIG. 10, as several tubes are stacked onto one another, the top edge of an underlying barrel will abut against the lug 42 which practically operates as a stop element for the insertion of the tubes.

With the disclosed arrangement, the containers or tubes will be nested into one another, by holding their respective side surfaces in a spaced condition, so as to discharge the loads at the band edge portion, which is preferably made of a metal material, so as to afford the possibility of quickly and easily disengage the tubes from the stack.

While the invention has been disclosed and illustrated with reference to a preferred embodiment thereof, it should be apparent that the disclosed embodiment is susceptible to several modifications and variations all of which will come within the scope and spirit of the accompanying claims.

We claim:

1. An automatic apparatus for making frustum of cone shaped fibre tubes comprising a substantially frustum of cone shaped drum, means for rotatively driving said drum, a paper sheet supply roller for supplying said drum with a paper sheet, paper sheet pressing means for pressing said paper sheet, on said drum, said paper sheet having on at least a face thereof, an adhesive layer, a cutting assembly arranged between said drum and said paper sheet supply roller for cutting the paper sheet, said drum being provided with a plurality of throughgoing holes, formed substantially along a generatrix and coupled to a vacuum source, said paper sheet supplying roller being provided with a plurality of circumferential slots, tangentially of which there are provided corresponding teeth arranged with a comb arrangement and adapted to detach said paper sheet from said drum.

2. An apparatus according to claim 1, wherein said cutting assembly comprises a cutting blade articulated at one end thereof a first double acting cylinder for rotatively reciprocating said cutting blade in a place perpendicular to said paper sheet and a second double acting cylinder for turning said cutting blade about a vertical axis substantially perpendicular to said paper sheet, so as to cut said paper sheet to a set size according to preset slanted cutting lines.

* * * * *